US008873768B2

(12) United States Patent
Zurek

(10) Patent No.: US 8,873,768 B2
(45) Date of Patent: Oct. 28, 2014

(54) METHOD AND APPARATUS FOR AUDIO SIGNAL ENHANCEMENT

(75) Inventor: Robert A. Zurek, Antioch, IL (US)

(73) Assignee: Motorola Mobility LLC, Libertyville, IL (US)

( * ) Notice: Subject to any disclaimer, the term of this patent is extended or adjusted under 35 U.S.C. 154(b) by 1881 days.

(21) Appl. No.: 11/021,350

(22) Filed: Dec. 23, 2004

(65) Prior Publication Data

US 2006/0140417 A1 Jun. 29, 2006

(51) Int. Cl.
*H04R 3/00* (2006.01)
*H04R 25/00* (2006.01)

(52) U.S. Cl.
CPC ..... *H04R 3/005* (2013.01); *H04R 2201/401* (2013.01); *H04R 2410/01* (2013.01); *H04R 25/407* (2013.01)
USPC ..... 381/92

(58) Field of Classification Search
USPC ..... 381/91, 92, 95, 111, 113, 122, 356
See application file for complete search history.

(56) References Cited

U.S. PATENT DOCUMENTS

| | | | | |
|---|---|---|---|---|
| 2,396,222 | A | 3/1946 | Foldy | |
| 2,678,967 | A | 5/1954 | Grosskopf | |
| 4,334,740 | A | 6/1982 | Wray | |
| 6,041,127 | A * | 3/2000 | Elko | 381/92 |
| 6,614,911 | B1 | 9/2003 | Watson et al. | |
| 2003/0142836 | A1 * | 7/2003 | Warren et al. | 381/92 |
| 2003/0160862 | A1 | 8/2003 | Charlier et al. | |
| 2003/0174852 | A1 * | 9/2003 | Klinke | 381/356 |

FOREIGN PATENT DOCUMENTS

| | | | |
|---|---|---|---|
| EP | 0869697 | A2 | 10/1998 |
| EP | 1035752 | A1 | 9/2000 |
| WO | WO 02/065735 | A2 | 8/2002 |
| WO | WO 03/041285 | A1 | 5/2003 |

OTHER PUBLICATIONS

Eargle, John. The Microphone Book. Focal Press, 2004. pp. 50-54, 84, and 85.*

Henry F. Olson, "Gradient Microphones", The Journal of the Acoustical Society of America, Jan. 1946, pp. 192-198, vol. 17, No. 3, RCA Laboratories, Princeton, New Jersey.

Gary W. Elko, "Superdirectional Microphone Arrays," in Acoustic Signal Processing for Telecommunication, Steven L. Gay and Jacob Benesty, eds., 2000, pp. 181-237.

* cited by examiner

*Primary Examiner* — Duc Nguyen
*Assistant Examiner* — Kile Blair
(74) *Attorney, Agent, or Firm* — Morris & Kamlay LLP

(57) ABSTRACT

A method for audio signal enhancement comprising obtaining (222) a first audio signal from a first physical microphone element and obtaining a second audio signal from a second physical microphone element. The audio signals are array processed (226) to generate a virtual linear first order element and a virtual non-linear even order element. The array processing (226) includes combining the virtual linear first order element and the virtual non-linear even order element to generate a directional audio signal having a primary audio beam. An apparatus is disclosed for implementing the method.

23 Claims, 14 Drawing Sheets

METHOD AND APPARATUS FOR AUDIO SIGNAL ENHANCEMENT

CROSS-REFERENCES TO RELATED APPLICATION

This application is related to the following U.S. patent application:

application Ser. No. 11/021,395 entitled "Multielement Microphone" by Robert A. Zurek; and the related application is filed on even date herewith, is assigned to the assignee of the present application, and is hereby incorporated herein in its entirety by this reference thereto.

FIELD OF THE INVENTION

This invention relates in general to audio signal enhancement, and more specifically to a method and apparatus for audio signal enhancement.

BACKGROUND OF THE INVENTION

Microphones are often employed in noisy environments where a plurality of audio sources and noise are present in a sound field. In such situations, audio signal enhancement is used to obtain the desired audio signal. High quality enhancement of the desired audio signal, detection of the direction of an audio source generating the desired audio signal and noise suppression are important issues to be addressed for audio signal enhancement.

BRIEF DESCRIPTION OF THE DRAWINGS

Refer now to figures, which are exemplary, not limiting, and wherein like elements are numbered alike in several figures and, as such may not be discussed in relation to each figure.

DETAILED DESCRIPTION

Disclosed herein is a method and apparatus for audio signal enhancement. The method and apparatus utilize a microphone array comprising angularly separated physical microphone elements that can be integrated into small portable electronic devices such as portable communication devices. The method and apparatus further utilize a mixture of linear and non-linear processing of audio signals obtained from the microphone array to generate a directional audio signal with a distortion that is low enough for the method and apparatus to be efficiently used in intelligible speech communication.

One embodiment is a method for audio signal enhancement that obtains a first audio signal from a first physical microphone element and obtains a second audio signal from a second physical microphone element. The audio signals are array processed to generate a virtual linear first order element and a virtual non-linear even order element. The array processing includes combining the virtual linear first order element and the virtual non-linear even order element to generate a directional audio signal having a primary audio beam.

Another embodiment is an apparatus for audio signal enhancement. The apparatus includes a first physical microphone element and a second physical microphone element. A first divider scales an audio signal from the first physical microphone element by a scaling factor and a second divider scales an audio signal from the second physical microphone element by the scaling factor. A processor array processes the scaled audio signals to generate a virtual linear first order element and a virtual non-linear even order element, and combines the virtual linear first order element and the virtual non-linear even order element to generate a directional audio signal comprising a primary audio beam. A multiplier multiplies the directional audio signal by the scaling factor to maintain an output level consistent with the input level to the system.

Figure 1:
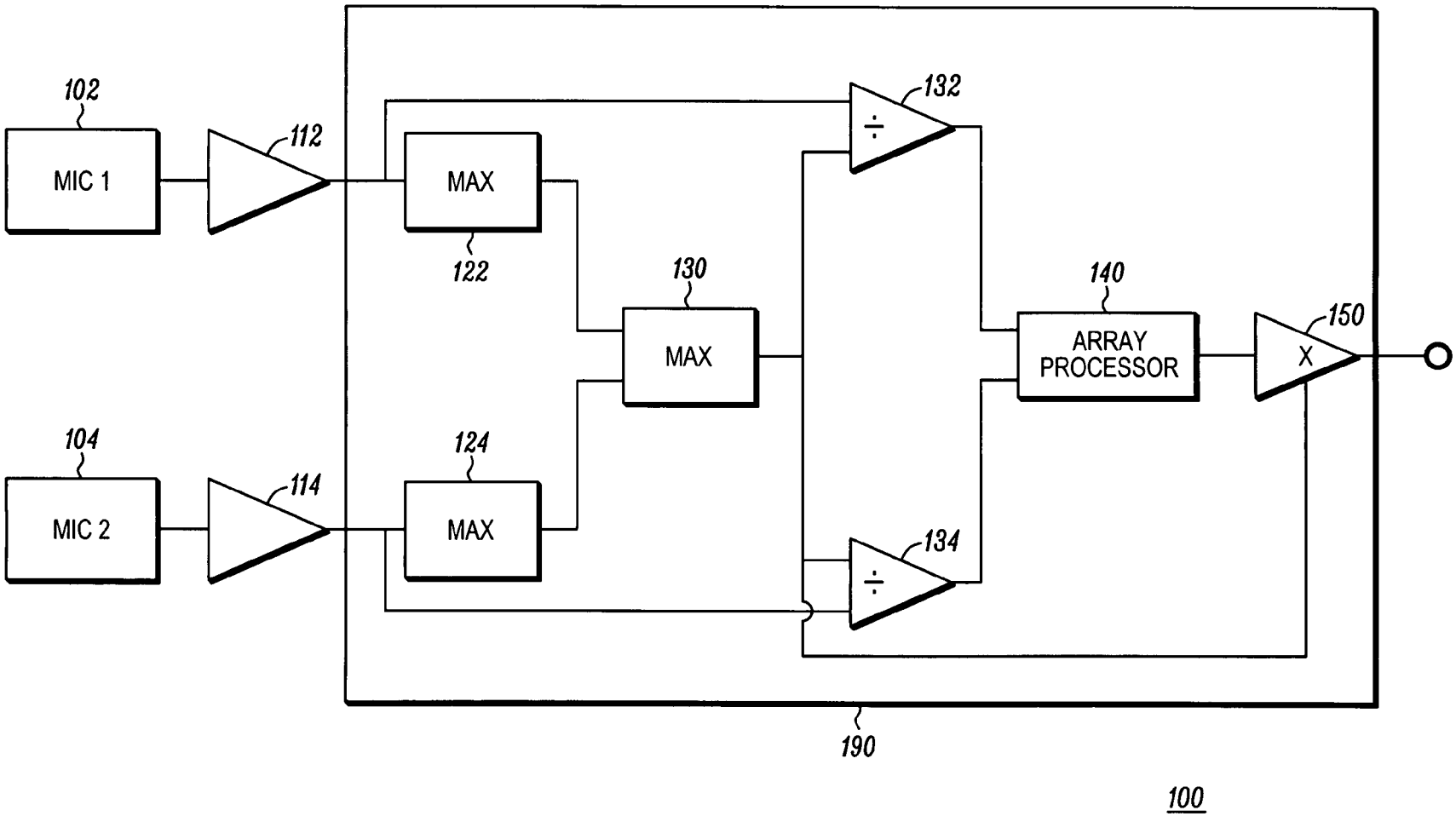
FIG. 1 is a block diagram illustrating one embodiment of an apparatus for audio signal enhancement.

FIG. 1 is a block diagram of an apparatus 100 for audio signal enhancement, in accordance with one embodiment of the invention. The apparatus 100 includes a first physical microphone element 102 and a second physical microphone element 104. As described in further detail herein, more than two microphone elements may be used. The output signals from the microphone elements 102 and 104 are provided to amplifiers 112 and 114, respectively, to calibrate the gain of the microphone elements 102 and 104. The outputs of amplifiers 112 and 114 are divided into time windows, and then provided to maximum signal detectors 122 and 124. The maximum signal detectors detect and hold the maximum signal output from the amplifiers 112 and 114 for a given time window. The maximum signal detector having the larger amplitude is selected at maximum signal selector 130. This signal is then used as a scaling factor at dividers 132 and 134 to scale the output signals from amplifiers 112 and 114. This processing normalizes the outputs of the amplifiers 112 and 114. The normalized microphone signals are then array processed by array processor 140. The array processing is described in further detail herein. The resultant of the array processing is then scaled through a multiplier 150 using the same scaling factor employed at dividers 132 and 134. An audio signal enhancement block 190, indicates the processing components that operate using time windows.

In embodiments of the invention, the distance separating the physical microphone elements 102 and 104 is less than one-half of the wavelength of the shortest wavelength of interest. For example, if the frequency is full-range audio (20-20,000 Hz), then the shortest wavelength of interest is 17.3 millimeters. If the frequency is telephone audio (300-3400 Hz) then the shortest wavelength is 100 millimeters.

Figure 2:
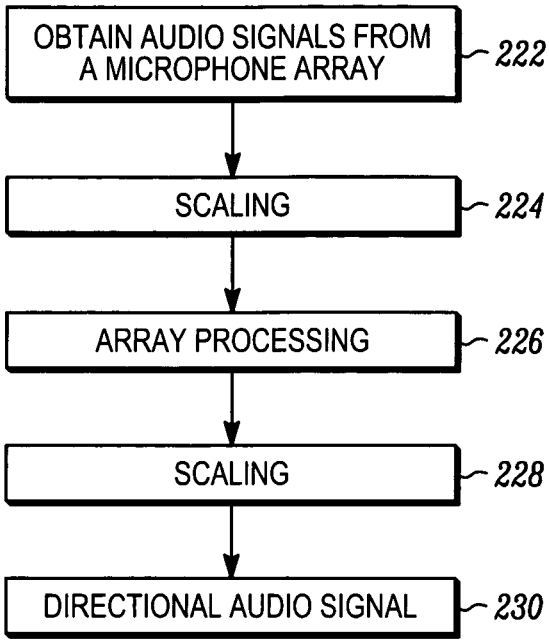
FIG. 2 is a flow diagram illustrating one embodiment of a method for audio signal enhancement.

Referring to FIG. 2, a flow diagram depicting a method for audio signal enhancement within each time window or frame is illustrated. The first step, as indicated by step 222, obtains audio signals from a microphone array, the microphone array comprising two or more physical microphone elements 102 and 104. The audio signals are then scaled at step 224 (e.g., by dividers 132 and 134). At step 226, the audio signals are array processed to generate a virtual linear first order element and a virtual non-linear even order element. The virtual linear first order element and the virtual non-linear even order element are combined. The array processing is described in further detail herein. Step 228 comprises scaling the audio signal, again, this time performing the inverse operation as that performed in step 224, namely multiplying the audio signal by the scaling factor (e.g., at multiplier 150). As indicated at step 230, the resultant is a directional audio signal comprising a primary beam.

The processing of steps 222-230 may be performed by a processor such as a general-purpose microprocessor executing code, a digital signal processor (DSP), an application specific integrated circuit (ASIC), a combination of software, hardware and/or firmware, etc. Thus, the term processor as used herein is intended to have a broad meaning encompassing a variety of components for implementing the described method.

The microphone array comprises first order directional elements or a combination comprising first order directional elements and omnidirectional elements. The first order directional elements are "non-dimensional." As used herein, the term "non-dimensional" refers to physical microphone elements, which have a size that is small compared to the wavelength of sound. This is typically achieved in a single microphone capsule by introducing an acoustic delay element (e.g., a felt or screen) in the rear path to the microphone's diaphragm. An angular response of a first order directional element can be represented as $P(\phi)$ and is expressed as in equation (1) where $0<\alpha<1$:

$$P(\phi)=\alpha+(1-\alpha)*\text{Cosine}(\phi).$$

Figure 3:
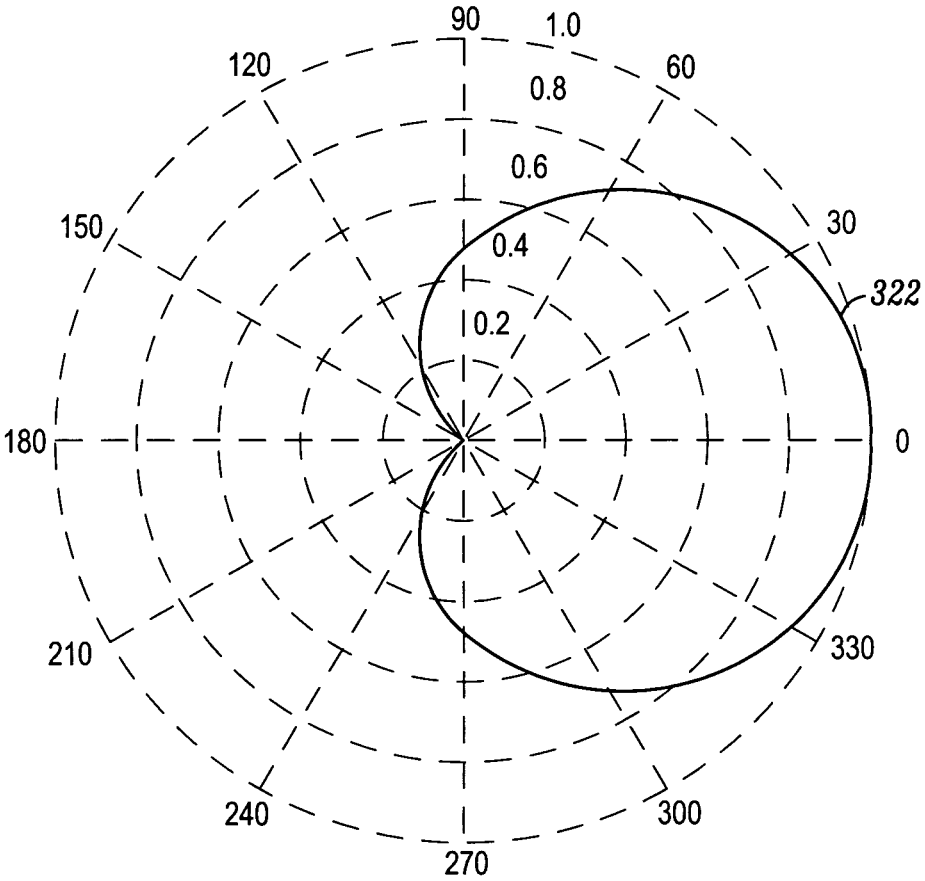
FIG. 3 illustrates an angular response of a first order uni-directional or cardioid element.

FIG. 3 illustrates an angular response 322 of a first order directional element. As used herein, the first order directional elements include first order cardioid elements, first order non-cardioid elements, as well as combinations comprising at least one of the foregoing elements.

Figure 4:
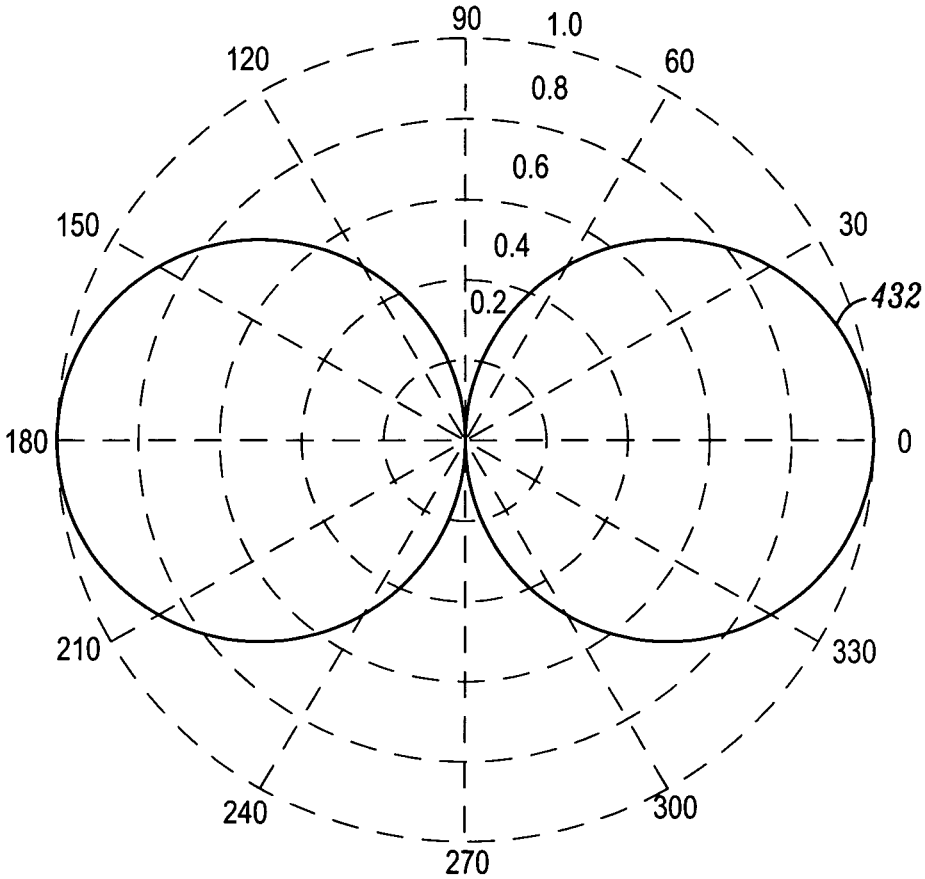
FIG. 4 illustrates an angular response of a first order bi-directional element.

FIG. 4 illustrates an angular response 432 of a first order bi-directional element. The virtual first order bi-directional element is generated when alpha has a value of 0 in equation (1). The angular response 432 is a response that has equal maximum angular response in both front and the rear directions.

Figure 5:
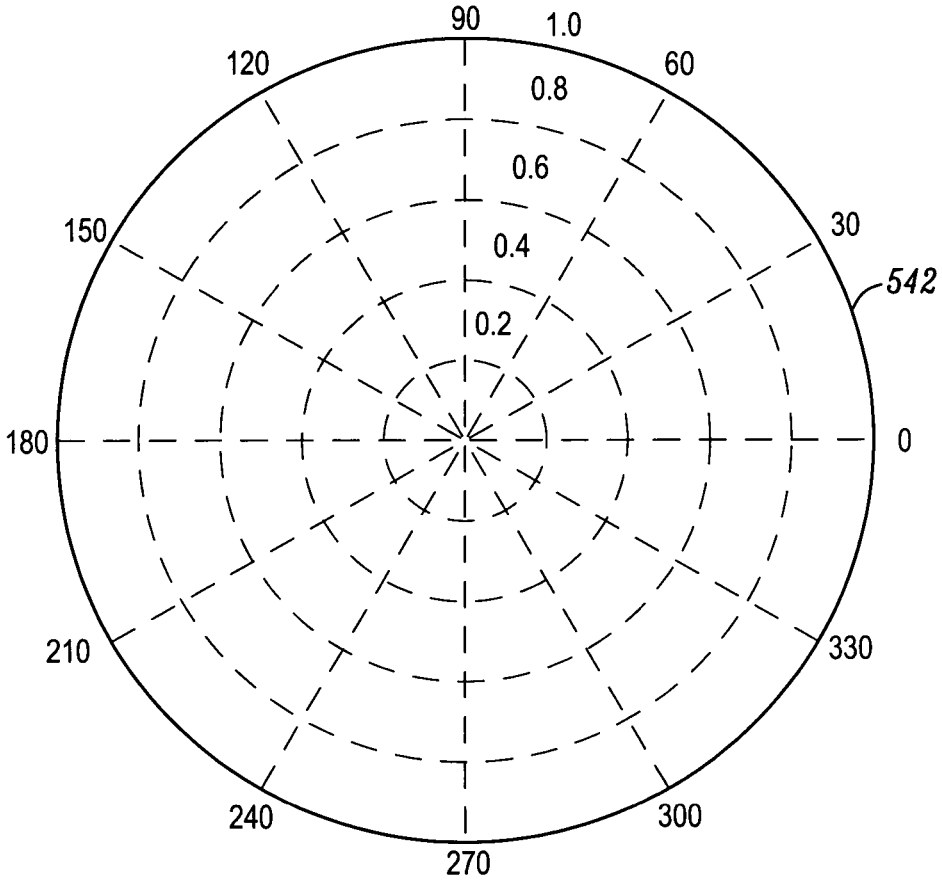
FIG. 5 illustrates an angular response of an omnidirectional element.

FIG. 5 illustrates an angular response 542 of a omnidirectional element. The virtual omnidirectional element is generated when alpha has a value of 1 in equation (1). The angular response 542 is a response that has equal angular response in all the directions.

Figure 6:
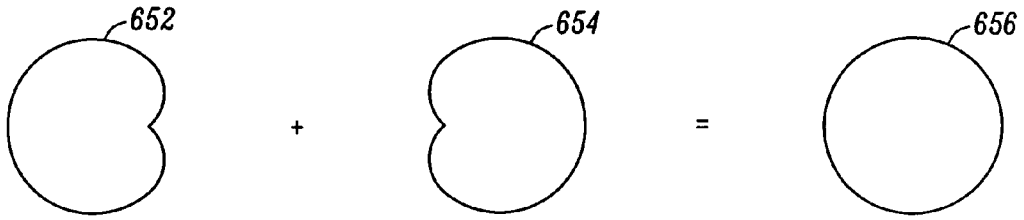
FIG. 6 illustrates mathematical addition of opposing angular responses of first order uni-directional or cardioid elements.
Figure 7:
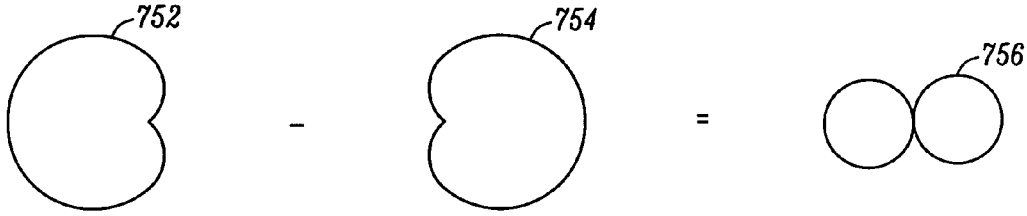
FIG. 7 illustrates mathematical subtraction of opposing angular responses of first order uni-directional or cardioid elements.

First order directional elements may be used to generate virtual first order bi-directional elements and virtual omnidirectional elements. FIG. 6 illustrates a mathematical addition of opposing angular responses 652 and 654 of first order directional physical microphone elements to generate an angular response 656 of a virtual omnidirectional element. FIG. 7 illustrates a mathematical subtraction of opposing angular responses 752 and 754 of first order directional physical microphone elements to generate an angular response 756 of a virtual first order bi-directional element. For non-cardioid elements, weighted addition and subtraction has to be used for generating the virtual first order bi-directional and virtual first order omnidirectional elements.

A virtual linear first order element is generated by linearly mixing a real or virtual first order bidirectional element with a real or virtual omnidirectional element. A virtual non-linear even order element is generated by raising a real or virtual first order bi-directional element to an even power (n).

Figure 8:
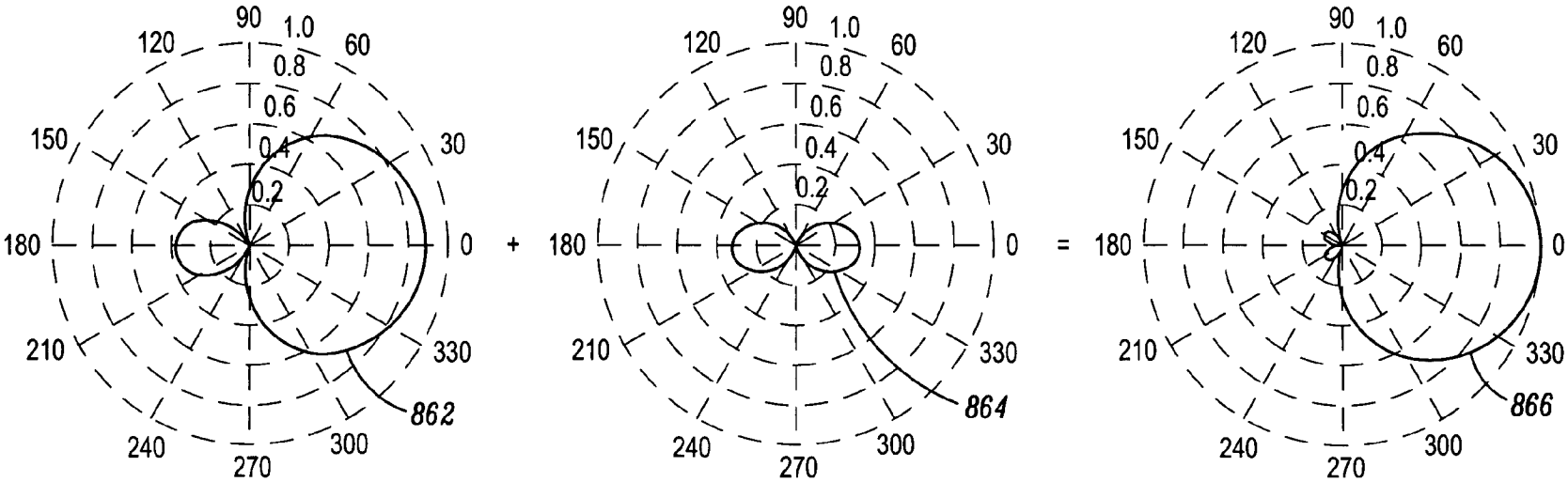
FIG. 8 illustrates the mathematical addition of an angular response of a virtual linear first order element to an angular response of a virtual non-linear even order element to generate a resultant hybrid array.

Referring to FIG. 8, in one embodiment, an angular response 862 of a linear first order element is mathematically added to an angular response 864 of a virtual non-linear even order element (the value of n is 2) to generate a hybrid resultant array signal comprising the directional audio signal represented by an angular response 866. The directional audio signal may have a primary beam with a very low distortion.

A hybrid resultant array (X) for dipole order n with 2 minor lobes is expressed in Equation (2):

$$X=\frac{M_1+\left(\frac{n\sqrt{2}}{2}\right)(M_1-M_2)+\left(\frac{n\sqrt{2}}{2^n}\right)(M_1-M_2)^n}{2\left(1+n\sqrt{2}\right)}$$

Figure 9:
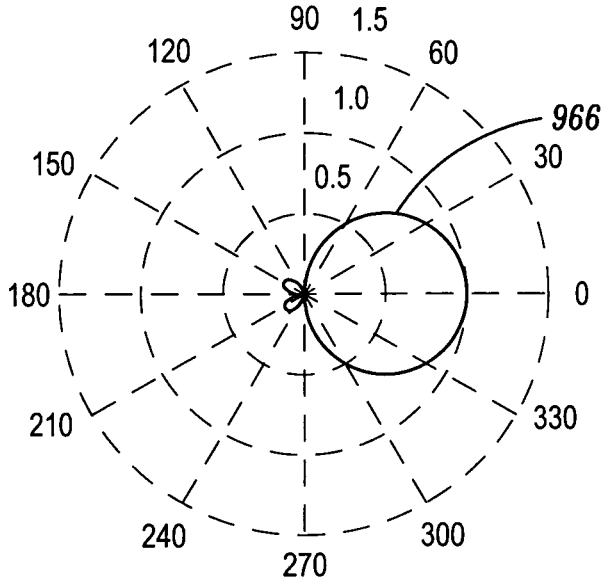
FIG. 9 illustrates a resultant hybrid array for dipole order n with 2 minor lobes.

In Equation (2) $M_1$ represents a first audio signal obtained from a first physical directional microphone element and $M_2$ represents a second audio signal obtained form a second physical directional microphone element. FIG. 9 illustrates a sample angular response 966 for the hybrid resultant array (X) for dipole order n with 2 minor lobes.

A hybrid resultant array (X) for dipole order n with 3 minor lobes is expressed in Equation (3):

$$X=\frac{M_1+\left(\frac{n\sqrt{2}}{2}\right)(M_1-M_2)+\left(\frac{C_n(n-1)\sqrt{2}}{2^{(n-1)}}\right)(M_1-M_2)^n}{2\left(1+\left(\frac{n}{2}\right)\sqrt{2}+C_n(n-1)\sqrt{2}\right)}$$

Figure 10:
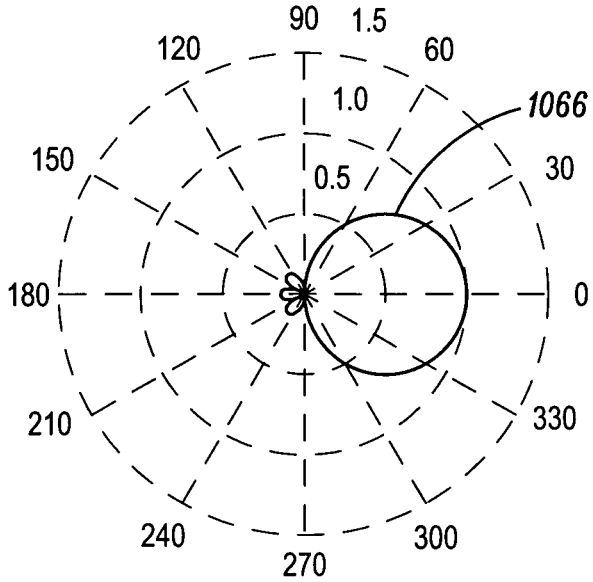
FIG. 10 illustrates a resultant hybrid array for dipole order n with 3 minor lobes.

In Equation (3) $M_1$ represents a first audio signal obtained form a first physical directional microphone element and $M_2$ represents a second audio signal obtained form a second physical directional microphone element. FIG. 10 illustrates a sample angular response 1066 for the hybrid resultant array (X) for dipole order n with 3 minor lobes.

Equations 2 and 3 assume the first order directional elements are of the cardioid form. If a non-cardioid physical element is used, the equations would have to be modified accordingly. In this case, $M_1$ would be the sum of a real or virtual omnidirectional element with a real or virtual bidirectional element, the sum of which is then divided by two. $M_2$ would be the difference of a real or virtual omnidirectional element and a real or virtual bidirectional element, the sum of which is then divided by two.

Figure 11:
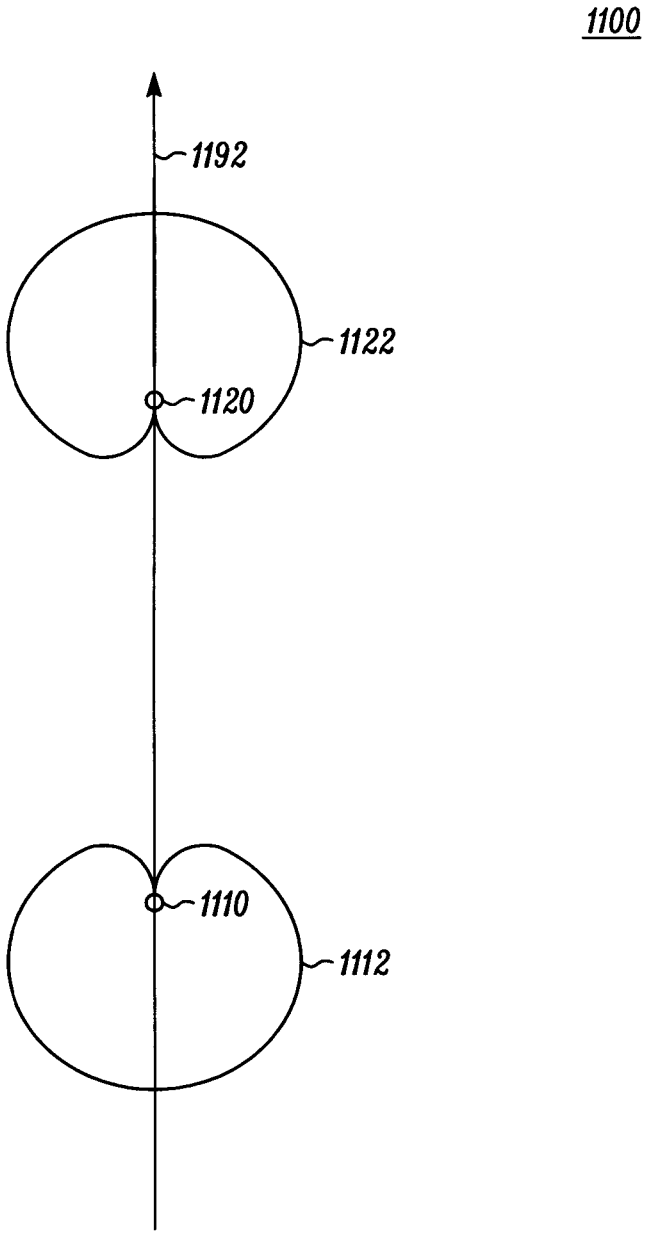
FIG. 11 illustrates a microphone array having two first order uni-directional physical microphone elements, in accordance with one embodiment of the invention.

As illustrated in FIG. 11, in one embodiment, the microphone array 1100 comprises two physical microphone elements: a first physical microphone element 1110 that is a first order directional element having an angular response 1112 for a first audio signal obtained from the first physical microphone element 1110; and a second physical microphone element 1120 that is a first order directional element having an angular response 1122 for a second audio signal obtained from the second physical microphone element 1120. The first physical microphone element 1110 and the second physical microphone element 1120 are at an angular separation of 180 degrees to each other parallel to a beam axis 1192. In this embodiment, the first physical microphone element 1110 and the second physical microphone element 1120 are actually on the beam axis 1192. A primary audio beam is oriented along the beam axis 1192.

Figure 12:
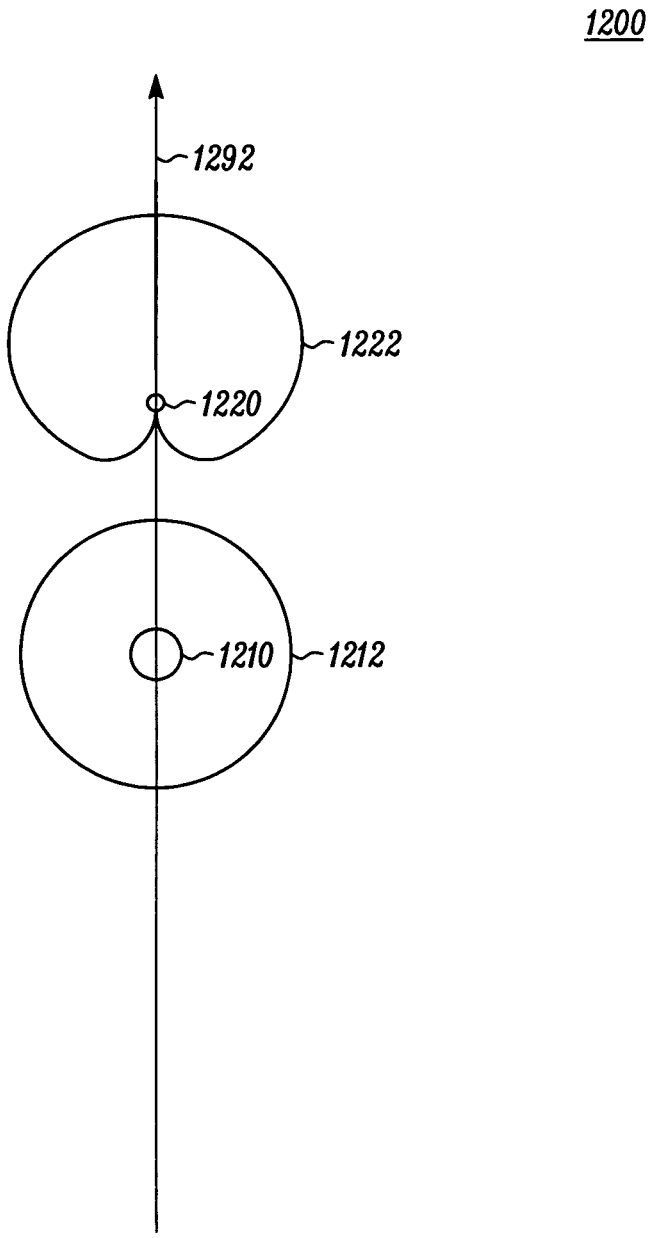
FIG. 12 illustrates a microphone array having one first order unidirectional physical microphone element and one omnidirectional physical microphone element, in accordance with one embodiment of the invention.

As illustrated in FIG. 12, in one embodiment, the microphone array 1200 comprises: a first physical microphone element 1210 that is an omnidirectional element having an angular response 1212 for a first audio signal obtained from the first physical microphone element 1210; and a second physical microphone element 1220 that is a first order directional element having an angular response 1222 for a second audio signal obtained from the second physical microphone element 1220. The second physical microphone element 1220 is oriented parallel to the beam axis 1292. In this embodiment, the first physical microphone element 1210 and the second physical microphone element 1220 are actually on the axis 1292. A primary audio beam is oriented along a beam axis 1292.

Figure 13:
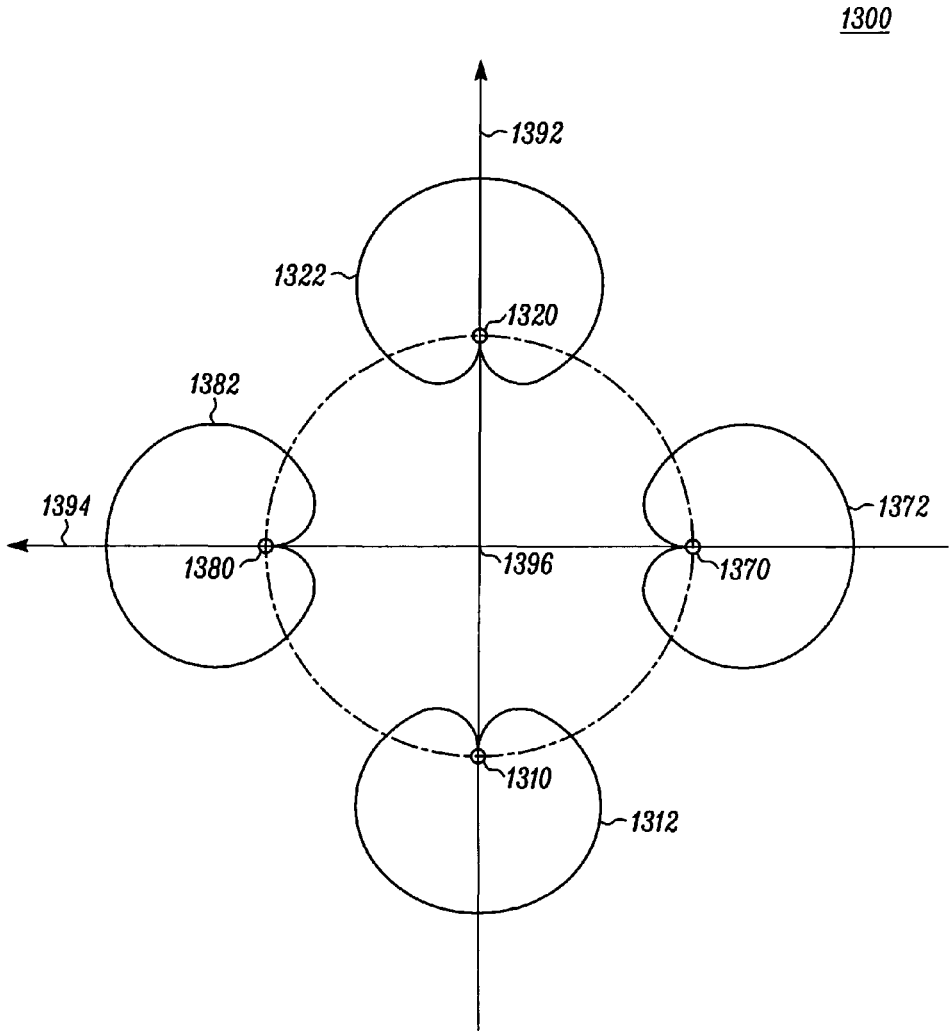
FIG. 13 illustrates a microphone array having four first order uni-directional physical microphone elements in accordance with one embodiment of the invention.

As illustrated in FIG. 13, in one embodiment, the microphone array 1300 comprises four physical microphone elements: a first physical microphone element 1310 that is a first order directional element having an angular response 1312 for a first audio signal obtained from the first physical microphone element 1310; a second physical microphone element 1320 that is a first order directional element having an angular response 1322 for a second audio signal obtained from the second physical microphone element 1320; a third physical microphone element 1370 that is a first order directional element having an angular response 1372 for a third audio signal obtained from the third physical microphone element 1370; and a fourth physical microphone element 1380 that is a first order directional element having an angular response 1382 for a fourth audio signal obtained from the fourth physical microphone element 1380.

The first physical microphone element 1310 and the second physical microphone element 1320 are at an angular separation of 180 degrees to each other and oriented along (or parallel to) a first axis 1392. The third physical microphone element 1370 and the fourth physical microphone element 1380 are at an angular separation of 180 degrees to each other and oriented along (or parallel to) a second axis 1394. The axes 1392 and 1394 may be orthogonal to each other, and in such a case, the microphone elements oriented along the first axis 1392 (i.e., the first physical microphone element and the second physical microphone element) are at an angular separation of 90 degrees from the physical microphone elements oriented along the second axis 1394 (i.e., the third physical microphone element and the fourth physical microphone element). In this embodiment, a primary audio beam is oriented along a vector originating at an intersection 1396 of the first axis 1392 and the second axis 1394, the vector having a tip that can be steered through 360 degrees in a plane formed by the first axis 1392 and the second axis 1394.

Figure 14:
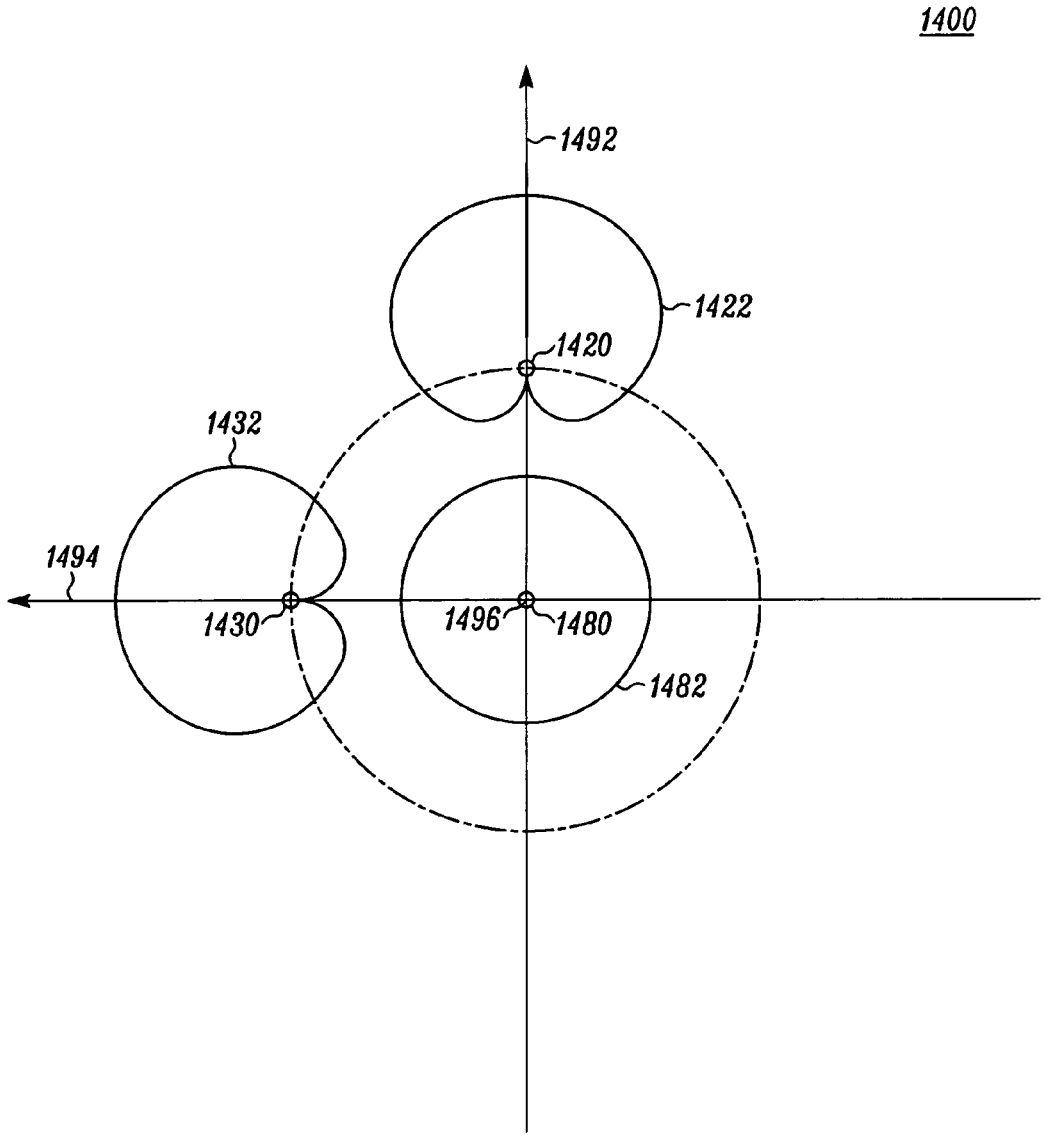
FIG. 14 illustrates a microphone array having two first order unidirectional physical microphone elements and one omnidirectional element, in accordance with one embodiment of the invention.

As illustrated in FIG. 14, in one embodiment, the microphone array 1400 comprises three physical microphone elements: a first physical microphone element 1420 that is a first order directional element having an angular response 1422 for a first audio signal obtained from the first physical microphone element 1420; a second physical microphone element 1480 that is an omnidirectional element having an angular response 1482 for a second audio signal obtained from the second physical microphone element 1480; and a third physical microphone element 1430 that is a first order directional element having an angular response 1432 for a third audio signal obtained from the third physical microphone element 1430.

The first physical microphone element 1420 is oriented along a first axis 1492. The third physical microphone element 1430 is oriented along a second axis 1494. The axes 1492 and 1494 may be orthogonal to each other, and in such a case, the microphone element oriented along the first axis 1492 (i.e., the first physical microphone element) is at an angular separation of 90 degrees from the physical microphone element oriented along the second axis 1494 (i.e., the third physical microphone element). In this embodiment, a primary audio beam is oriented along a vector originating at an intersection 1496 of the first axis 1492 and the second axis 1494, the vector having a tip that can be steered completely through 360 degrees in a plane formed by the first axis 1492 and the second axis 1494.

Figure 15:
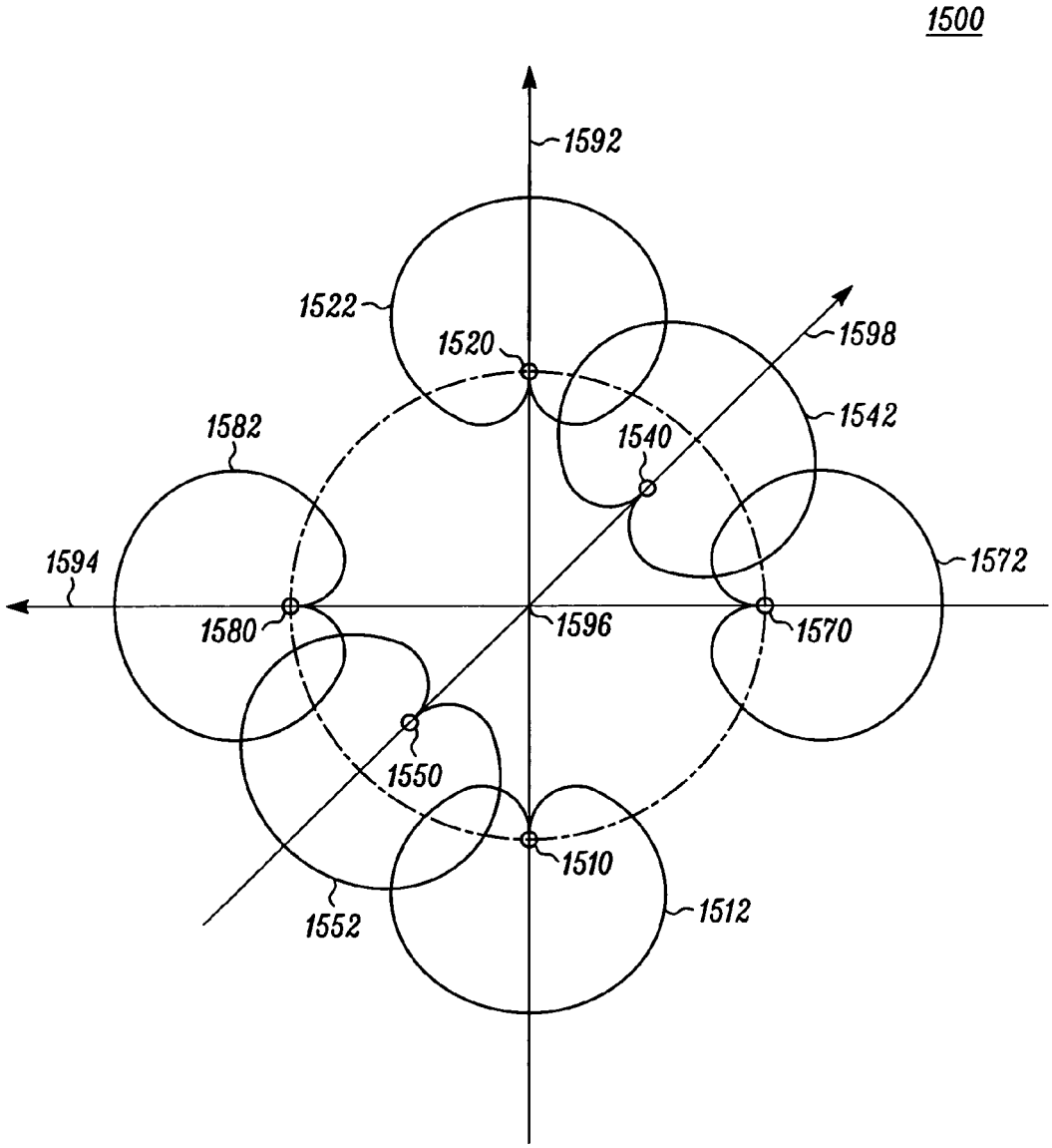
FIG. 15 illustrates a microphone array having six first order uni-directional physical microphone elements, in accordance with one embodiment of the invention.

As illustrated in FIG. 15, in one embodiment, the microphone array 1500 comprises six physical microphone elements, i.e., a first physical microphone element 1510 that is a first order directional element having an angular response 1512 for a first audio signal obtained from the first physical microphone element 1510; a second physical microphone element 1520 that is a first order directional element having an angular response 1522 for a second audio signal obtained from the second physical microphone element 1520; a third physical microphone element 1570 that is a first order directional element having an angular response 1572 for a third audio signal obtained from the third physical microphone element 1570; a fourth physical microphone element 1580 that is a first order directional element having an angular response 1582 for a fourth audio signal obtained from the fourth physical microphone element 1580; a fifth physical microphone element 1540 that is a first order directional element having an angular response 1542 for a fifth audio signal obtained from the fifth physical microphone element 1540; and a sixth physical microphone element 1550 that is a first order directional element having an angular response 1552 for a sixth audio signal obtained from the sixth physical microphone element 1550.

The first physical microphone element 1510 and the second physical microphone element 1520 are at an angular separation of 180 degrees to each other and oriented along (or parallel to) a first axis 1592. The third physical microphone element 1570 and the fourth physical microphone element 1580 are at an angular separation of 180 degrees to each other and oriented along (or parallel to) a second axis 1594. The fifth physical microphone element 1540 and the sixth physical microphone element 1550 are at an angular separation of 180 degrees to each other and oriented along (or parallel to) a third axis 1598. The axes 1592, 1594 and 1598 may be orthogonal to each other, and in such a case, the microphone elements oriented along the first axis 1592 (i.e., the first physical microphone element and the second physical microphone element) are at an angular separation of 90 degrees from the physical microphone elements oriented along the second axis 1594 (i.e., the third physical microphone element and the fourth physical microphone element) and also at an angular separation of 90 degrees from the physical microphone elements oriented along the third axis 1598 (i.e., the fifth physical microphone element and the sixth physical microphone element). In this embodiment, a primary audio beam is oriented along a vector originating at an intersection 1596 of the first axis 1592, the second axis 1594 and the third axis 1598, the vector having a tip that can be steered completely through a sphere formed about the intersection of the first axis 1592, second axis 1594 and third axis 1598.

Figure 16:
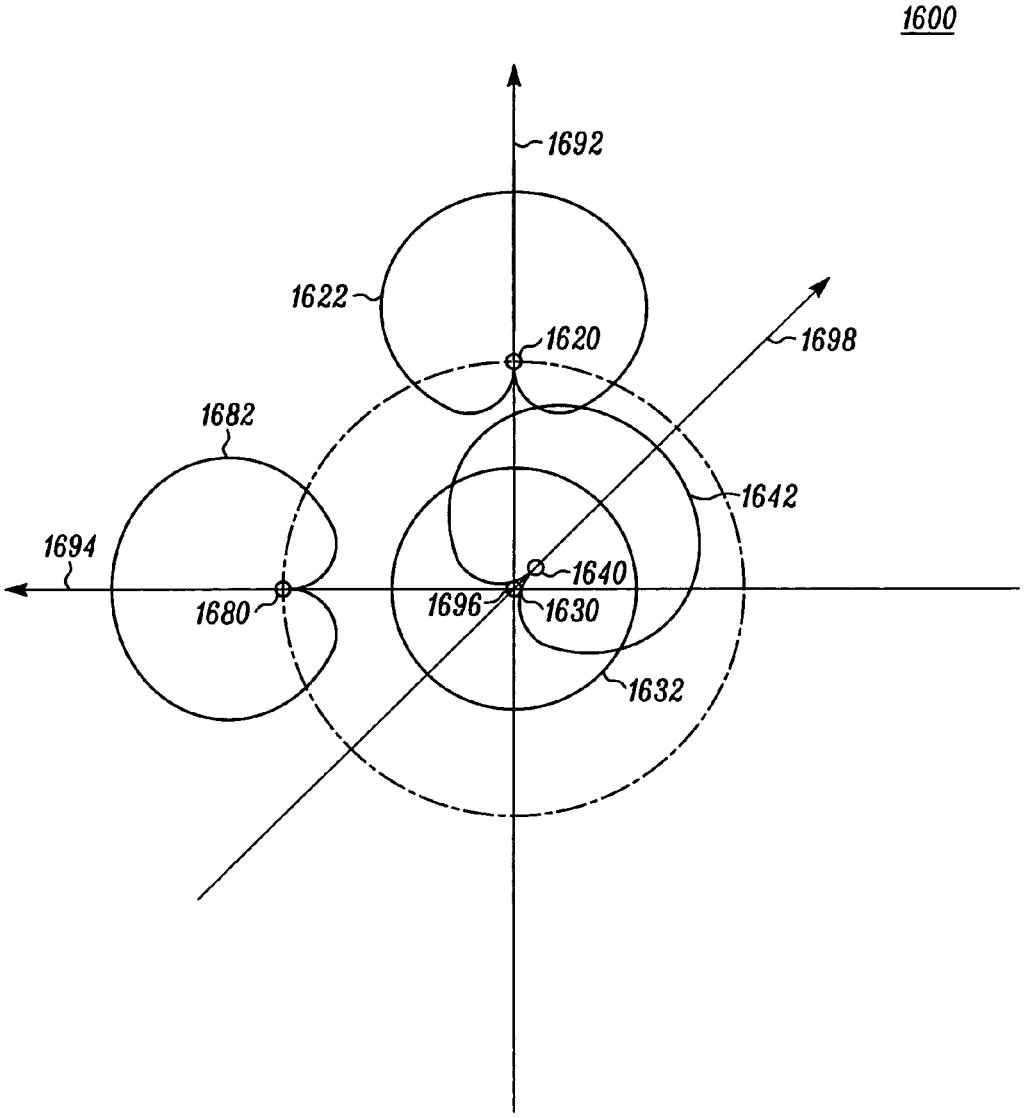
FIG. 16 illustrates a microphone array having three first order uni-directional physical elements and one omnidirectional physical microphone element, in accordance with one embodiment of the invention.

As illustrated in FIG. 16, in one embodiment, the microphone array 1600 comprises four physical microphone elements, i.e., a first physical microphone element 1620 that is a first order directional element having an angular response 1622 for a first audio signal obtained from the first physical microphone element 1620; a second physical microphone element 1680 that is a first order directional element having an angular response 1682 for a second audio signal obtained from the second physical microphone element 1680; a third physical microphone element 1640 that is a first order directional element having an angular response 1642 for a third audio signal obtained from the third physical microphone element 1640; and a fourth physical microphone element 1630 that is an omnidirectional element having an angular response 1632 for a fourth audio signal obtained from the fourth physical microphone element 1630.

The first physical microphone element 1620 is oriented along a first axis 1692; the second physical microphone element 1680 is oriented along a second axis 1694; the third physical microphone element 1640 is oriented along a third axis 1698; and the fourth physical microphone element 1630 is at the intersection 1696 of the first axis 1692, the second axis 1694 and the third axis 1698. The axes 1692, 1694 and 1698 may be orthogonal to each other, and in such a case, the first physical microphone element 1620, the second physical microphone element 1680, and the third physical microphone element 1640 are at an angular separation of 90 degrees to each other. In this embodiment, a primary audio beam is oriented along a vector originating at an intersection 1696 of the first axis 1692, the second axis 1694 and the third axis 1698, the vector having a tip that can be steered completely through a sphere formed about the intersection of the first axis 1692, second axis 1694 and third axis 1698.

As described above, the embodiments of the disclosure addresses the issue for audio signal enhancement by generating the directional audio signal with low distortion. The method and apparatus of the disclosure enable angularly differentiated microphone elements in a microphone array in a small assembly. Such microphone arrays allow for simpler packaging, product integration, and therefore reducing the cost involved in the processing. Such assemblies can be embedded in handsets, helmet microphones, hearing aids, portable recording devices, position and/or location sensors, automotive systems, and the like, as well as combinations comprising at least one of the foregoing. Possible applications that can utilize this audio signal array processing include: animation and sound recording, systems for voice memo, hands-free telephones, teleconference systems, guest-reception systems, automotive systems, and the like.

All ranges disclosed herein are inclusive and combinable, meaning ranges of "up to about 180" or "about 90 to about 180" are inclusive of the endpoints and all intermediate values of the ranges. The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. A method for time-domain audio signal enhancement, the method comprising:

obtaining a first time-domain audio signal, $M_1$, from a first physical microphone element;

obtaining a second time-domain audio signal, $M_2$, from a second physical microphone element oriented differently than the first physical microphone element;

array processing the first time-domain audio signal and the second time-domain audio signal to generate a virtual linear first order element, $M_1$-$M_2$;

array processing the first time-domain audio signal and the second time-domain audio signal to generate a virtual non-linear even order element, $(M_1\text{-}M_2)^n$, where n is an even number; and combining the virtual linear first order element and the virtual non-linear even order element to generate a directional time-domain audio signal having a primary audio beam.

2. The method of claim 1, wherein the virtual linear first order element is added to the virtual non-linear even order element to generate the directional time-domain audio signal.

3. The method of claim 2, wherein array processing the first time-domain audio signal and the second time-domain audio signal to generate the virtual non-linear even order element comprises:

raising a first order bi-directional element to an even power.

4. The method of claim 3, wherein the first order bi-directional element is a virtual first order bi-directional element created by:

taking a mathematical difference of the first time-domain audio signal and the second time-domain audio signal, wherein the first physical microphone element is a first order directional element and the second physical microphone element is a first order directional element.

5. The method of claim 2, wherein array processing the first time-domain audio signal and the second time-domain audio signal to generate the virtual linear first order element comprises:

linearly mixing a first order bi-directional element and an omnidirectional element.

6. The method of claim 5, wherein the first order bi-directional element is a virtual first order bi-directional element created by:

taking a mathematical difference of the first time-domain audio signal and the second time-domain audio signal, wherein the first physical microphone element is a first order directional element and the second physical microphone element is a first order directional element.

7. The method of claim 5, wherein the omnidirectional element is a virtual omnidirectional element created by:

taking a mathematical sum of the first time-domain audio signal and the second time-domain audio signal, wherein the first physical microphone element is a first order directional element and the second physical microphone element is a first order directional element.

8. The method of claim 1, wherein the primary audio beam is oriented along a beam axis parallel with an orientation of at least the first physical microphone element.

9. The method of claim 1, further comprising:

obtaining a third time-domain audio signal from a third physical microphone element; and obtaining a fourth time-domain audio signal from a fourth physical microphone element, wherein the first physical microphone element and the second physical microphone element are oriented parallel to a first axis, and the third physical microphone element and fourth physical microphone element are oriented parallel to a second axis, and wherein the first axis is orthogonal to the second axis.

10. The method of claim 9, wherein the primary audio beam is oriented along a vector whose origin is at an intersection of the first axis and the second axis and whose tip can be steered through 360 degrees in a plane formed by the first axis and the second axis.

11. The method of claim 9, further comprising:

obtaining a fifth time-domain audio signal from a fifth physical microphone element;

obtaining a sixth time-domain audio signal from a sixth physical microphone element;

wherein the fifth physical microphone element and sixth physical microphone element are oriented parallel to a third axis, and wherein the third axis is orthogonal to the first axis and the second axis.

12. The method of claim 11, wherein the primary audio beam is oriented along a vector whose origin is at an intersection of the first axis, the second axis and the third axis, and whose tip can be steered through a sphere centered at the intersection of the first axis, the second axis and the third axis.

13. An apparatus for time-domain audio signal enhancement, comprising:

a first physical microphone element that is a first order directional element;

a second physical microphone element;

a first divider for scaling a time-domain audio signal, $M_1$, from the first physical microphone element by a scaling factor to produce a first scaled time-domain audio signal;

a second divider for scaling a time-domain audio signal, $M_2$, from the second physical microphone element by the scaling factor to produce a second scaled time-domain audio signal;

a processor for array processing the first scaled time-domain audio signal and the second scaled time-domain audio signal to generate a virtual linear first order element, $M_1$-$M_2$, and a virtual non-linear even order element, $(M_1-M_2)^n$, where n is an even number, and combining the virtual linear first order element and the virtual non-linear even order element to generate a directional time-domain audio signal comprising a primary audio beam; and a multiplier for multiplying the directional time-domain audio signal by the scaling factor.

14. The apparatus of claim 13 wherein the scaling factor is based on a magnitude of a largest time-domain audio signal from the first physical microphone element and the second physical microphone element.

15. The apparatus of claim 13 wherein the second physical microphone element is a first order directional element.

16. The apparatus of claim 13 wherein the second physical microphone element is an omnidirectional element.

17. The apparatus of claim 13 further comprising:

a first amplifier for calibrating gain of the first physical microphone element; and a second amplifier for calibrating gain of the second physical microphone element.

18. The apparatus of claim 13, wherein a distance separating the first physical microphone element and the second physical microphone element is less than one-half of a wavelength of a shortest wavelength of interest.

19. The apparatus of claim 13, wherein the first physical microphone element and the second physical microphone element are oriented approximately in parallel to a first axis and at an angular separation of about 180 degrees to each other.

20. The apparatus of claim 19, further comprising a third physical microphone element and a fourth physical microphone element oriented approximately in parallel to a second axis and at an angular separation of about 180 degrees to each other.

21. The apparatus of claim 20, wherein the second axis is orthogonal to the first axis.

22. The apparatus of claim 20, further comprising a fifth physical microphone element and a sixth physical microphone element oriented approximately in parallel to a third axis and at an angular separation of about 180 degrees to each other.

23. The apparatus of claim 22, wherein the third axis is orthogonal to the first axis and the second axis.

* * * * *